United States Patent [19]

Hersh et al.

[11] Patent Number: 4,596,921

[45] Date of Patent: Jun. 24, 1986

[54] LOW NOISE HAND-HELD HAIRDRYER

[76] Inventors: Alan S. Hersh, 10707 Overman Ave.; Murray S. Welkowsky, 19730 Romar St., both of Chatsworth, Calif. 91311

[21] Appl. No.: 612,880

[22] Filed: May 22, 1984

[51] Int. Cl.[4] ..... F24H 3/04; H05B 1/00

[52] U.S. Cl. ..... 219/370; 219/369; 219/375; 181/225; 310/51

[58] Field of Search ..... 219/366, 368, 369, 370, 219/371, 375, 373; 132/7, 9, 11, 112; 181/224, 211, 222, 225; 34/96, 97, 98, 90, 99, 100, 101; 415/119; 310/51, 50, 47

[56] References Cited

U.S. PATENT DOCUMENTS

| | | | |
|---|---|---|---|
| 3,261,107 | 7/1966 | Ponczek et al. | 219/370 X |
| 3,418,452 | 12/1968 | Grabner | 219/370 |
| 3,540,547 | 11/1970 | Coward, Jr. | 181/225 |
| 3,613,257 | 10/1971 | Yashiike et al. | 219/370 X |
| 3,779,341 | 12/1973 | Huggins | 181/225 |
| 3,941,339 | 3/1976 | McCarty | 310/51 X |
| 4,135,080 | 1/1979 | Wells, Jr. | 219/370 |
| 4,185,688 | 1/1980 | Wlater et al. | 181/225 X |
| 4,279,325 | 7/1981 | Challis | 181/225 X |

*Primary Examiner*—Clarence L. Albritton
*Assistant Examiner*—M. M. Lateef
*Attorney, Agent, or Firm*—Blakeley, Sokoloff, Taylor & Zafman

[57] ABSTRACT

A hand-held hair dryer with a high level of sound and vibration suppression. The hair dryer includes sound absorbing material attached to the inner surface of the hair dryer housing and having a selected density to provide maximum sound absorption in a relatively thin layer of material. A motor with integral fan is mounted on the hair dryer handle by an elastomeric vibration isolator so as to be isolated from the dryer housing. The fan blade noise, in part absorbed by the sound absorbing material on the inner surface of the hair dryer housing, is further grossly suppressed by special sound absorbing structures located at the extreme inlet and outlet of the housing, such as a structure functioning as a Helmholtz resonator, with that structure itself being vibration isolated from the hair dryer housing. Preferably an aerodynamically designed heater is used downstream of the fan to minimize the vortex noise. Also, vibration isolation between the handle and the main housing assembly provides good low frequency vibration absorption, particularly with the motor being supported through the handle rather than through the main housing itself. Various embodiments and other features of the invention are also disclosed.

36 Claims, 7 Drawing Figures

LOW NOISE HAND-HELD HAIRDRYER

BACKGROUND OF THE INVENTION

1. Field of the Invention

The present invention relates to the field of hair dryers, and in particular low noise, hand-held hair dryers.

2. Prior Art

Hand-held hair dryers are well-known in the prior art. Such devices are generally sold in various sizes and configurations, and with various features, though all are characterized by a body having a motor and fan for air movement, a heater for heating the air and a handle for the convenient holding and movement thereof. In general the body of such devices is metal or hard plastic, with the motor being directly supported by the body or handle so that the motor vibrations are directly transmitted thereto. In addition, the fan blades themselves create substantial noise, part of which is transmitted through the rigid housing of the dryer and part of which simply passes outward through the outlet and inlet regions of the hair dryer. Further, the air velocity in the region of the heater downstream of the fan is relatively high, though the structure in such region, such as the heater and heater supports, is usually perpendicular to the air stream with no consideration of streamlining thereof. The net result is that commercially available hand held hair dryers, while varying somewhat from design to design, all generate very substantial noise within the audible region, typically on the order of 70 db or higher at a distance of 18 inches therefrom. While the noise signatures of various units also vary, most tend to show substantial noise which is synchronous with the fan blade passing speed (motor speed×the number of fan blades) and harmonics thereof, with the remainder of the noise being substantially white and spread throughout the remainder of the audible range. While units recommended for professional use may be superior in terms of life and reliability, in general they are not superior with respect to the noise generated in comparison to consumer units.

The high noise level of prior art hand held hair dryers is undesirable for various reasons. In particular, the noise drowns out all other sounds, normally making it impossible to carry on a conversation with others, to listen to a radio or TV, to hear the doorbell or telephone ring, etc. Accordingly, it would be highly desirable to significantly reduce the noise generated by such hair dryers for both social and safety reasons; while maintainin high air flow and heat capacities. As shall be seen from the known prior art discussed below, no substantial progress had been made in this direction prior to the present invention. Grabner (U.S. Pat. No. 3,418,452) discloses a dryer for drying persons bodies with warm air after bathing. This dryer includes a sleeve of insulating material mounted inside the casing. The insulating material, however, is thermal insulation and not sound insulation for sound absorbing purposes. There is also included a strip of insulating material interposed between the motor and its mounting bracket to dampen vibrations. However, as the main body is also used as the propeller shroud, the energy transmitted by the blade tip to the housing will serve to negate the beneficial effect of the strip, resulting in noise and vibrations to the main body.

Ponczek et al. (U.S. Pat. No. 3,261,107) discloses a hair dryer which has "dampening" rings around the motor casing. However, the motor is rigidly coupled to the shroud by the use of metal vanes and a metal motor bracket. Also, the spacing between the shroud and outer shell halves is quite small. Thus not only will the vanes result in vortex shedding and increased upstream airborne noise, but the close undamped spacing of the shroud to the outer shell, in conjunction with the rigid coupling of the motor to the shroud, will allow vibrational energy to be directly transmitted to the outer shell.

BRIEF SUMMARY OF THE INVENTION

A hand-held hair dryer with a high level of sound and vibration suppression. The hair dryer includes sound absorbing material attached to the inner surface of the hair dryer housing and having a selected density to provide maximum sound absorption in a relatively thin layer of material. A motor with integral fan is mounted on the hair dryer handle by an elastomeric vibration isolator so as to be isolated from the dryer housing. Such mounting prevents the noise generated by the coupling between the motor-fan into the main housing. To reduce inlet turbulence from interacting with the fan blades to destabilize, thereby varying the intensity of the blade rate passing tone, the inlet must be contoured to uniformly and smoothly accelerate initially ambient air into the fan blades. The overall motor and fan blade noises are attenuated by the sound absorbing material on the inner surface of the hair dryer housing. The fan blade passing rate tone is further attenuated by a special sound absorbing structure located at the hair dryer inlet and exhaust, such structures functioning as Helmholtz resonators. Preferably an aerodynamically designed heater is used downstream of the fan to minimize the vortex noise. Also, vibration isolation between the handle and the main housing assembly provides good low frequency vibration absorption, particularly with the motor being supported through the handle rather than through the main housing itself. Various embodiments and other features of the invention are also disclosed.

DETAILED DESCRIPTION OF THE INVENTION

Figures 1, 2:
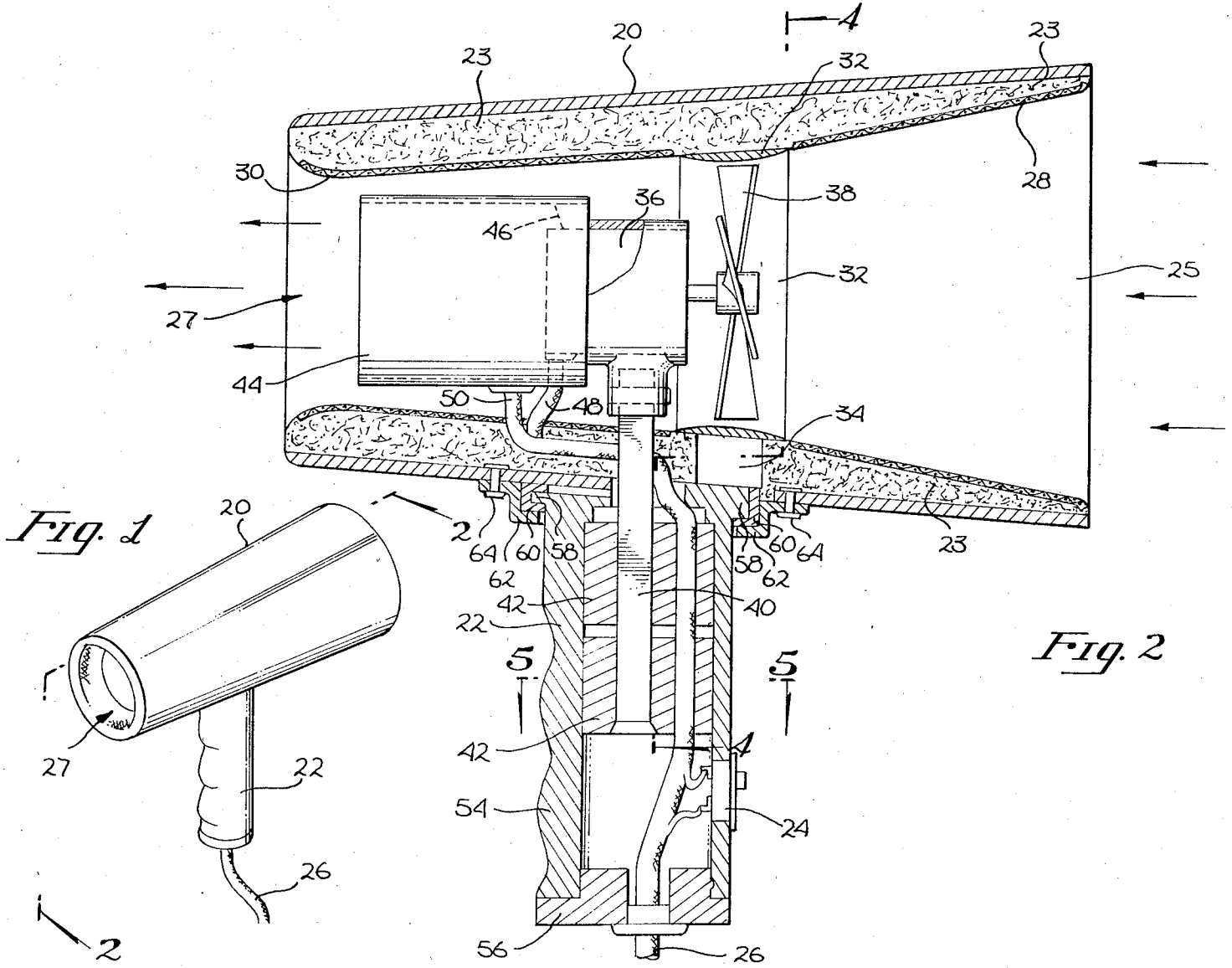
FIG. 1 is a perspective view of one embodiment of the invention.
FIG. 2 is a side partial cross section taken along the line 2—2 of FIG. 1.

First referring to FIG. 1, a perspective view of one embodiment of the present invention may be seen. It will be noted from this figure that this model is very similar in appearance to other commercially available hand-held hair dryers. Its main difference will be a somewhat larger diameter. As may be seen from FIG. 1, this embodiment is externally comprised of a housing 20 attached to a handle 22 supporting an on-off switch 24 and having a main power cord 26 extending from the lower end thereof.

The embodiment of FIG. 1 is shown in partial cross section in FIG. 2. As may be seen in this figure, housing 20 is lined on its interior with a sound absorbing material 23 in both the inlet section, generally indicated by the numeral 25, and the outlet section generally indicated by the numeral 27. The sound absorbing material is retained in position and maintained with the desired density by shaped screen-like members 28 and 30. Screen-like members 28 and 30 do not touch housing 20 or shroud 32 at any point. Rather, the screen and absorbing material 23, are "force-fit" into position in both the inlet and exhaust sections of the dryer such that the rigidity of the screen and the diameter of the screen-material combination results in a stable configuration against the inner wall of the housing. It will be noted that shroud 32 is not connected directly to the housing 20 but rather is supported on one or more vibration isolation members 34 from handle 22, so that the vibration of member 32 is not transmitted directly to the housing. The screen-like members 28 and 30 are preferably reasonably fine wire screen members of a substantially open construction so as to not themselves present any substantial rough surface to the airflow through the hair dryer, and further, so as to present an insignificant area for the impingement of sound waves thereon in comparison to the total inner surface area of the sound absorbing material 23. If self-supporting sound absorbing materials 23 are used, then screen members 28 and 30 may be eliminated. Mounted within the housing 20 (but not supported therefrom) is a motor 36 of conventional design, with a fan 38 attached thereto for forcing air through the hair dryer in the direction indicated. Fan 38 shown in FIG. 2 is a four bladed fan, though of course fans of fewer or greater numbers of blades may also be used.

It will be noted from FIG. 2 that the motor 36 is supported on a vertical post or tube 40 which extends into the handle 22 and is supported therefrom on a pair of vibration absorbing isolating members 42 which may be cylindrical in a general O-ring shape or other suitable form for mounting of the post 40 to the handle 22. Similarly, vibration isolation members 34 may also be of the above shapes. Supported from the motor within the exhaust section 26 of the hair dryer is a heater assembly 44. This heater assembly preferably is comprised of a thin wall tubular insulator having a toroidally wound heater thereon utilizing either an appropriate diameter Nichrome or other heater wire, or alternatively utilizing flat Nichrome or other appropriate heater wire as commonly used in kitchen toasters and the like. In any event, in the embodiment shown in FIG. 2 the heater 44 is supported from motor 36 by aerodynamically shaped support members 46 so that in effect the heater assembly as well as the motor is supported through post 40. Power for both the motor 36 and heater 44 is provided through flexible power lines 48 and 50, respectively, as controlled by a switch 24 fastened to the handle 22. Obviously of course, more than one switch may be provided to provide independent motor control, more than one heater setting, etc.

In the embodiment shown, the handle 22 is comprised of a main handle member 54 of hollow design, with a bottom cap member 56 snapped thereinto, though obviously the design on the handle is a matter of choice. In another preferred embodiment, the handles may be injection molded in two halves and screwed or otherwise fastened together along a vertical plane. Additional protection to further reduce residual vibrational energy not attenuated by the vibration absorbing isolation members 42 is shown in the embodiment of FIG. 2. Here the upper portion 58 of the handle is not fastened directly to the housing 20 of the hair dryer, but rather is clamped to the housing through a vibration isolator 60 by retainer 62 fastened to the housing by screws 64.

Figure 3:
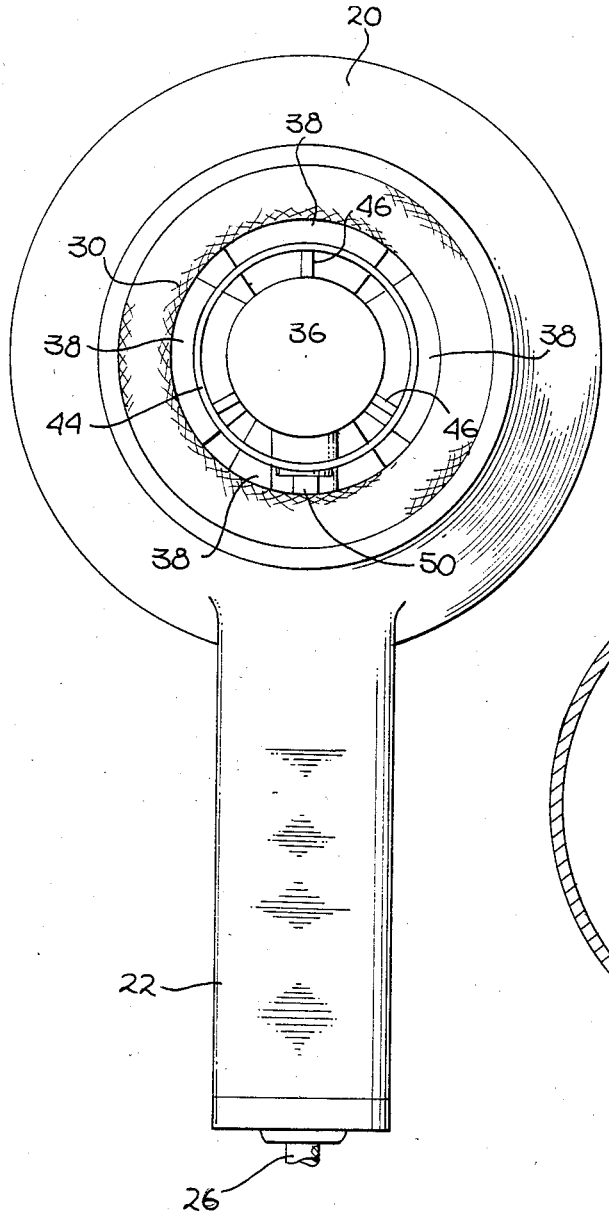
FIG. 3 is an end view of the hair dryer of FIG. 1.
Figure 4:
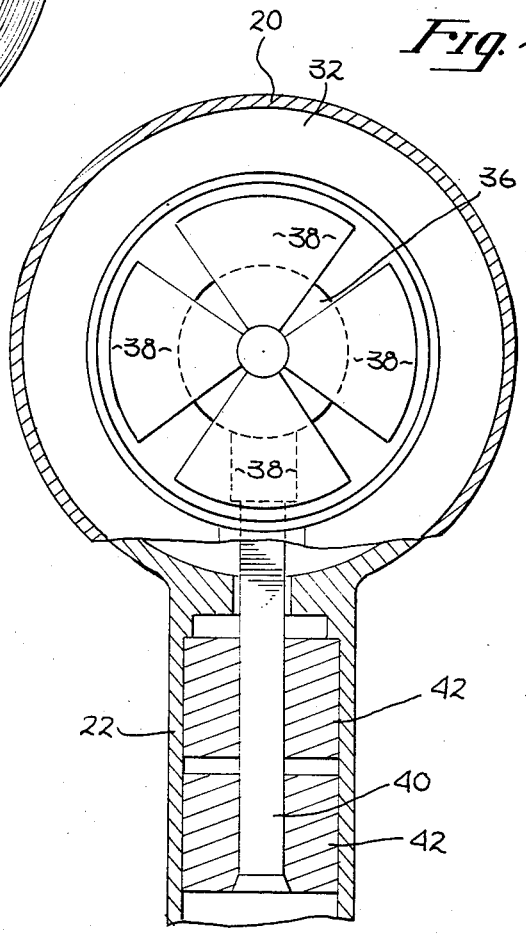
FIG. 4 is a partial cross sectional view taken along the line 4—4 of FIG. 2.
Figure 5:
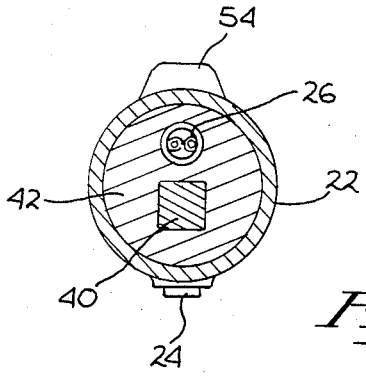
FIG. 5 is a partial cross sectional view taken along line 5—5 of FIG. 2.

Various of the parts which have been herein described with respect to FIG. 2 are also visible in FIGS. 3, 4 and 5, FIG. 3 being an exhaust end view of the hair dryer, FIG. 4 being a partial cross section taken along line 4—4 of FIG. 2, and FIG. 5 being a cross section taken along line 5—5 of FIG. 2. It may be seen from the figures that the assembly is comprised of three primary masses, (1) the motor and heater, which are vibrationally isolated from (2) the handle 22, which in turn, is vibrationally isolated from (3) the housing 20. The motor itself, of course, is relatively heavy, by necessity comprising in part significant amounts of copper and iron. The housing 20 is generally the most massive subassembly of the hair dryer, not so much because of its wall thickness or density, but more because of its relative size. Finally, the handle in a typical hair dryer in accordance with the present invention will normally be relatively light, being comprised of a substantially hollow injection molded part or parts. In effect however, these three masses are connected in series, the motor being connected to the handle through a first spring, and the handle being connected to the housing through a second spring, both springs having a substantial damping, which spring rates and damping are controlled by design. A secondary parallel coupling takes place from shroud 32 into the handle through the shroud vibration isolation members 34. With respect to the damping of the vibration isolators, there are of course suitable moldable highly energy absorbent elastomeric materials such as silicon rubber, neoprene, and the like which may be readily used for this purpose. The presence of the relatively large masses on the ends of this series and parallel combination of masses assures very good absorption of vibration originating from the motor and air flow without the vibration being very apparent to the user through the handle of the hair dryer. In that regard, while obviously a carefully balanced motor, particularly a dynamically balanced motor and fan assembly would be highly beneficial, it has been found that excellent motor vibration and noise absorption may be achieved by the structure hereinbefore described without incurring the manufacturing expense of individually balancing each motor assembly.

Having described the various elements forming the embodiment of FIGS. 1 through 5, other details thereof will now be described. The inlet section is contoured as shown to accelerate ambient air from a relatively low speed at the large opening of the inlet section 25 to an appropriate value immediately upstream of the fan blades. This is accomplished in a smooth manner with minimal or no abrupt discontinuities in the inlet cross section, preferably with a cone of large angle. Various cross-sections such as circular and elliptical are permissible, the selection of a particular shape and size being dependent upon the amount of noise rejection desired as well as user acceptable size and cost constraints. The details of the axial distribution of the cross-sectional area requires special comment. Tests have shown that the ratio of the cross-sectional areas across the inlet section (i.e., at the leading edge of the inlet and just upstream of the fan blades) must be greater than unity and preferably as large as practical. Ratios near unity produce severe interactions between upstream generated disturbances in the form of inlet turbulence or vorticity and the fan blades. The interaction destabilizes the blade passing tone causing large variations in its amplitude, often greater than 10 dB. The instabilities and hence large variations in blade passing tones are almost eliminated with large ratios of cross-sectional areas across the inlet section. The exhaust portion of the dryer, of course, is similarly shaped to further accelerate the air while absorbing as much of the motor and other noise as possible.

The sound absorbing material 23 in the preferred embodiment is made of Kevlar, a high strengtn aramid microfiber material manufactured by E. I. Dupont & Co. Other fibrous materials can be used, of course, such as fiberglass. Microfiber constructed bulk sound absorbing materials share various common characteristics. They are constructed of relativity long, very small diameter fibers whose cross sections are usually circular or near circular. They absorb sound efficiently over a broadband frequency range defined by the acoustic Reynold number parameter $fd^2/\nu<100$, where f is the sound frequency of interest, d is the average diameter of the microfibers, and $\nu$ is the kinematic viscosity of the fluid medium (viz, air). The acoustic energy absorption process is related to viscous drag forces generated by interaction between the sound field and the material fibers. The above considerations also apply to open and closed cell type of bulk materials such as, for example, polyurethane. Here the microfiber diameters are replaced with effective cell diameters characteristic of the open and closed cell materials.

Implicit in the above restriction of small diameter fibers or cell diameters (such that $fd^2/\nu<100$) is that most of the space within the above sound absorbing material is occupied by the fluid medium (i.e., air). The parameter porosity $\Omega$ is introduced to define this, wherein $\Omega=1$ corresponds to no material (i.e., air only) and $\Omega=0$ corresponds to all material (i.e., no internal air cavities). The reduction of inlet noise is believed best using a value of $\Omega=0.96$ for Kevlar as the sound absorbing material. Selecting the material porosity at $\Omega=0.96$ appears to achieve the best absorption from a "practical" viewpoint of the blade passing tone of approximately 1250 Hz (250 Hz motor speed on an experimental unit having a five bladed fan) while providing excellent higher frequency sound absorption, though values in the range of 0.80 to 0.99 are acceptable Further improvement of the absorption of the blade passing tone can be achieved by varying the porosity of the liner across its thickness. The "best" way to distribute the porosity across the liner is to install a thin layer of very high porosity material (i.e., lightweight, say $\Omega=0.99$), at the liner-interior interface and then to install layers of systematically lower porosity material, the lowest layer being located immediately adjacent to the outer housing. Finally, minor improvements can be achieved by incorporating convection effects due to mean flow speed and refraction effects due to the mean flow velocity profile. Also, it is clear that the thickness of the sound absorbing material should be as large as practical to achieve the highest amount of noise reduction as possible, though obviously, a compromise must be made based on size, weight and required air flow constraints.

The importance of maintaining a smooth interior with minimal or no abrupt changes in cross sectional area has been demonstrated by using clay to reduce the interior discontinuities in an experimental unit, whereby the blade passing tone and high frequency noise generated was substantially reduced. The smoothing of the inlet interior as a means of reducing high frequency noise led to the development of the contoured shroud shown in FIG. 2. As shown, the shroud is tapered at both ends so as to provide for minimal discontinuities to the internal flow. Further, there are no air gaps between the shroud and the screen-line member 28. This is necessary to prevent secondary recirculating flow patterns from interacting with the fan blades generating local fluctuations in lift and drag which increase the amplitude of the blade passing tone or cause it to become more unstable in addition to interacting with the higher frequency broadband noise. Finally, the shroud is vibration-isolated from handle 22. also, the importance of a properly designed inlet to provide an efficient means of accelerating initially stationary air into the hair dryer inlet has been demonstrated by comparison between noise generated from a straight inlet and the noise generated by flaring or contouring the straight inlet. The flared inlet reduces not only the high frequency noise above 2000 Hz, but also the blade passing rate tone.

As may be seen in FIG. 2, the exhaust section consists of an annulus containing sound absorbing material, a heater element rigidly attached to the motor, a smooth internal cross section area and a contoured outlet. The noise reduction achieved by enclosing the hair dryer exhaust with an annulus of sound absorbing material (Kevlar) was demonstrated by making spectral sound measurements with and without the sound absorbing material. During these tests for the particular configuration selected, the inlet noise was suppressed by inserting the inlet into a large muffler. The overall "A"-weighted exhaust noise is reduced by 10 dB by wrapping the exhaust shell with Kevlar. A closer examination of the data shows that the fundamental fan blade passing rate was reduced by about 8 dB (at 1250 Hz) while the high frequency noise (above 2000 Hz) was reduced by more than 10 dB. In the 5000 Hz one-third octave band, the noise was reduced by more than 20 dB.

With respect to the rigid attachment of the heating element to the motor, since the motor is vibration-isolated from the hair dryer outer shell, the only effect of attaching the heater is to generate broadband flow noise. This is demonstrated on a typical configuration from a comparison of exhaust noise generated with and without the heater installed. The effect of attaching the heater element was to increase the overall "A"-weighted noise level by only 2 dB. This increase took place over the entire frequency range. This 2 dB increase was further reduced to nearly zero by increasing the outlet exhaust cross section area.

The importance of providing for efficient vibration isolation of the motor and propeller from the outer shell has been demonstrated by analyzing the noise signatures generated by five existing commercially available hair dryers All the hair dryers generated strong tones at the propeller fundamental blade passing rate. The "tones" propagate not only out the hair dryer inlet and exhaust sections, but also through the outer shells and handles. These three sound transmission paths are very audible to the human ear and can be identified by careful listening.

Figure 6:
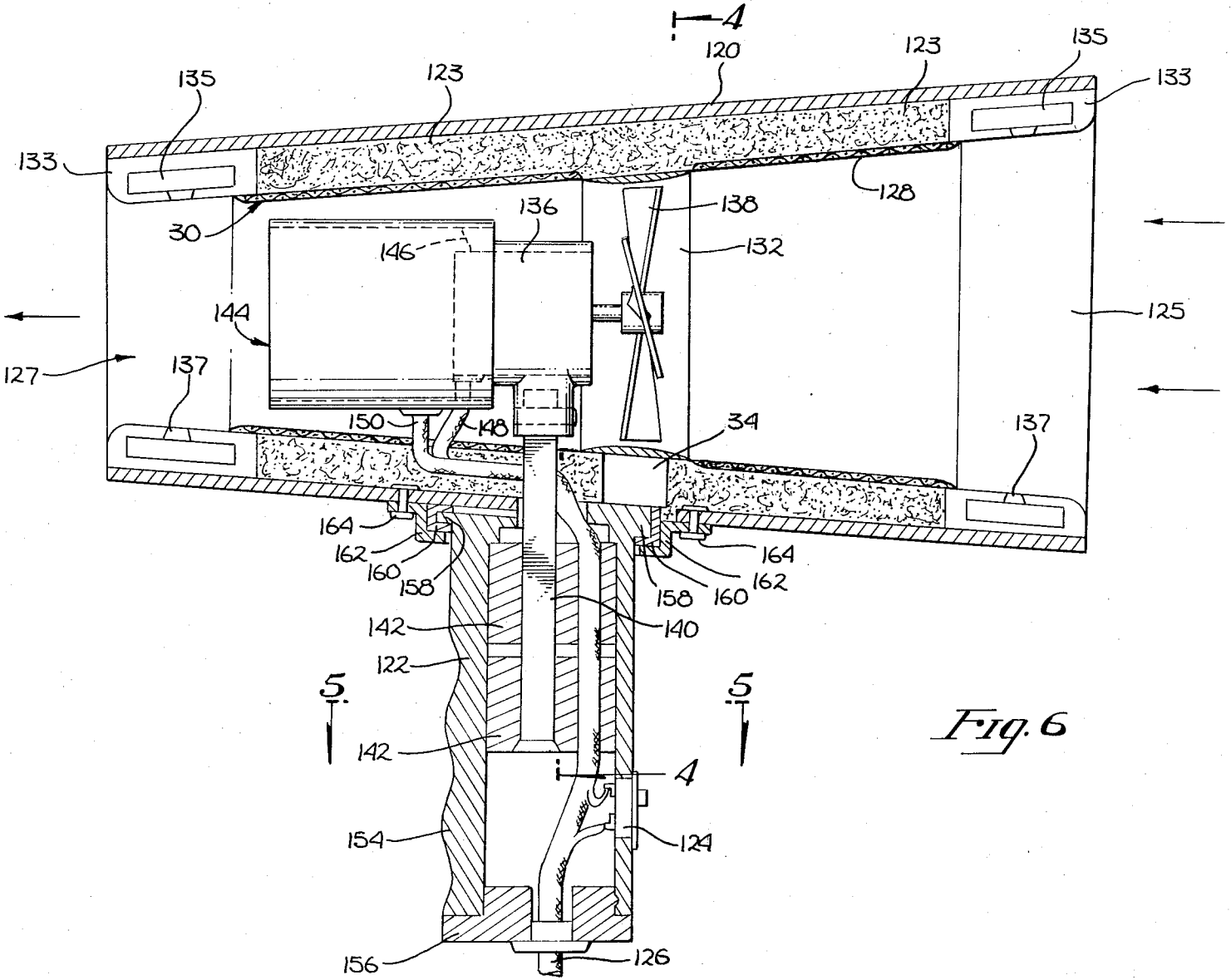
FIG. 6 is a side partial cross section of an alternate embodiment of this invention.
Figure 7:
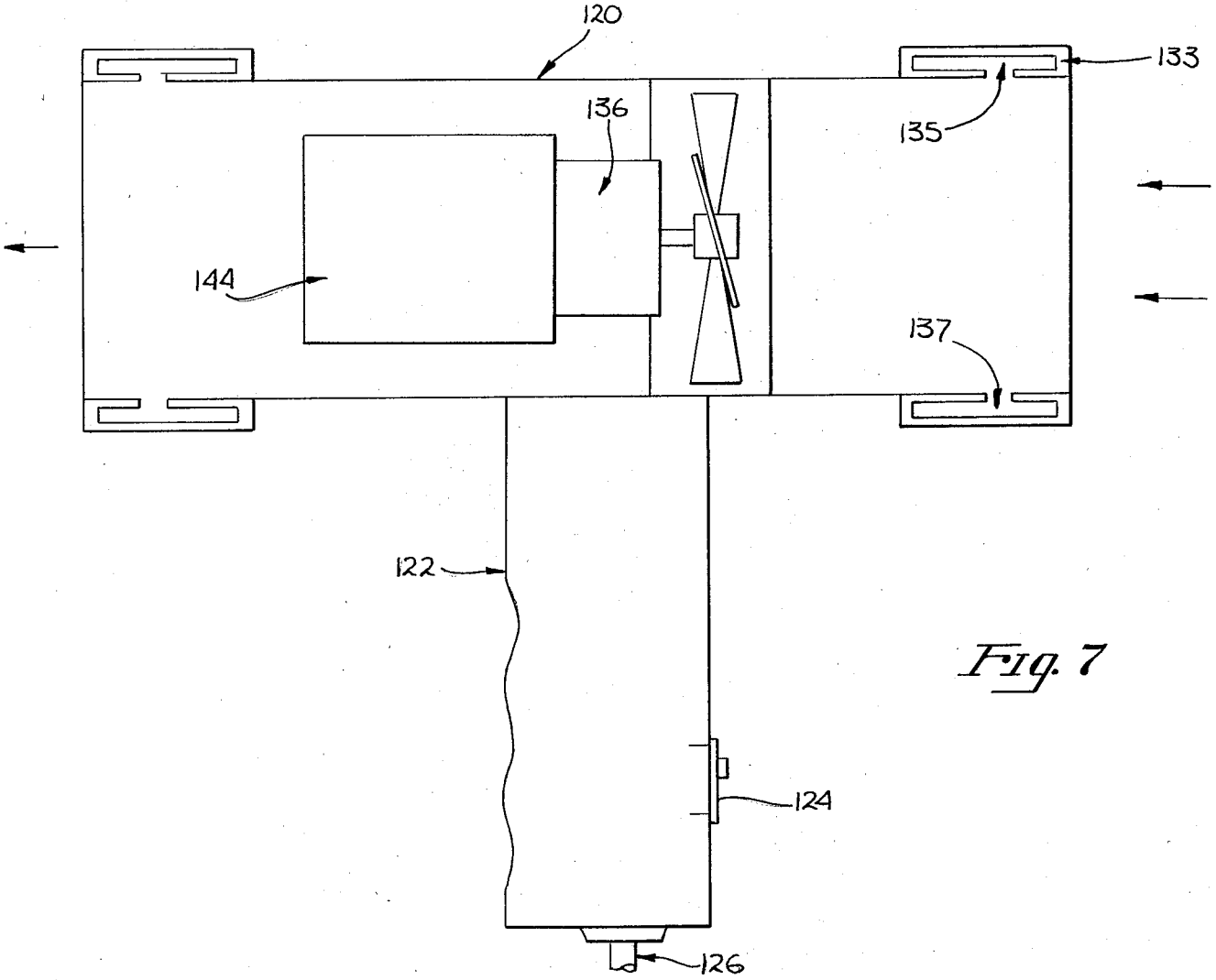
FIG. 7 is a side partial cross section of still another alternate embodiment.

Because of the relatively loud fan blade passing rate noise, it is desirable to take special precaution to absorb as much of that sound as possible Fortunately the motor speed and thus the fan blade passing rate will be relatively constant and therefore predictable in any particular design. The stable operation of the motor and fan permits the use of Helmholtz resonators to provide additional absorption of the blade passing tone. FIGS. 6 and 7 illustrate two possible applications of this concept. FIG. 6 shows two Helmholtz resonators disposed at the extreme inlet and exhaust locations to absorb residual blade passing tone not totally removed by the sound absorbing material along the entire inner wall. FIG. 7 shows a conventional hair dryer with two Helmholtz resonators also disposed at the extreme inlet and exhaust locations so as to be the only source of sound attenuation of the blade passing tone. This design concept may have application to those hair dryer configurations requiring minimal cost and/or size.

A Helmholtz resonator is in effect an acoustic oscillator having a resonant frequency tuned to the fan blade passing tone. The resonator geometry is determined by the size of the cavity of the resonator and the size of the orifices or the openings through which the gas may enter and escape from the cavity. In the context of members 133 of FIG. 6, the cavity is the cavity 135, with the orifices being the orifices 137. Equating the Helmholtz oscillator to a typical mechanical spring mass system, the equivalent of the spring is the compressability of the gas in the cavity 135, whereas the equivalent of the mass of the spring mass system is the effective mass of the air in (and to some extent around) the orifices. If the Helmholtz oscillator is tuned to the fan blade passing rate, then any pressure disturbance at the fan blade passing rate will cause the oscillator to oscillate, thereby acting as a large air source and sink at that frequency to effectively absorb the pressure disturbance rather than letting the pressure disturbance pass outward through housing or the inlet and outlet sections thereof. In that regard, a properly designed Helmholtz oscillator must take into account the effects of intense sound pressure levels and mean flow. While the oscillator will not be very effective with respect to harmonics of the fan blade passing rate, substantial reduction of the fundamental component is effective in obtaining a substantial reduction of the overall fan blade noise. Further, of course, the harmonics are more readily attenuated by the sound absorbing material 23 in the inlet and outlet areas of the hair dryer so that the combination of the Helmholtz oscillator and the sound absorbing material is quite effective in substantially reducing the total fan blade noise.

Now referring to FIGS. 6 and 7, it will be noted that various parts of this embodiment are identified by three digit numerals, such as the housing 120 and the handle 122. All such parts correspond in function, if not in detailed design, to the parts identified in FIGS. 1 through 5 by the second two digits of the three digit numbers, i.e., housing 20 and handle 22 of the earlier described embodiment. It may be seen from the embodiment of FIG. 6 that many aspects of this embodiment are similar to the embodiment described with respect to FIGS. 1 through 5, the primary difference being the addition of Helmholtz resonators at the inlet and exhaust sections While such an embodiment of FIG. 7 is not as quiet as the embodiment of FIGS. 1 through 6, it is very compact, and still a significant improvement over commercially available hair dryers currently being offered. In that regard, it has been found that incorporation of the various aspects of the present invention into a hand held hair dryer results in a reduction in noise by up to 20 db or more without any substantial increase in the weight and size thereof or meaningful decrease in the airflow therethrough. This reduction in noise in accordance with the present invention brings the noise down to levels enabling normal conversation, listening to the radio, etc. while the hair dryers are running. Further, the reduction in noise has been achieved in the present invention without any substantial increase in cost of the hair dryers, so that hair dryers in accordance with the invention may be offered commercially at prices which are not out of line in comparison to prices of conventional hand held hair dryers. While three embodiments of the present invention have been disclosed and described in detail herein, it will be obvious to those skilled in the art that various changes in form and detail may be made in the invention without departing from the spirit and the scope thereof.

We claim:

1. A hand-held hairdryer comprising a substantially rigid housing having an inlet and an outlet for airflow therethrough;

a substantially rigid handle means, said housing being coupled to said handle means;

a motor within said housing, said motor being mounted on vibration isolation means within said handle means, said vibration isolation means being an elastic means for absorbing vibrational energy between said motor and said handle means;

a fan mounted on said motor and oriented to encourage airflow through said housing from said inlet to said outlet;

a nonrotating shroud within said housing and encircling said fan an electric heater mounted in said housing downstream of said fan; and a sound absorbing material lining said housing between said inlet and said outlet thereof, said sound absorbing material being shaped so as to provide a substantially smooth duct free of rapid changes in duct cross-section area along its length for airflow between said inlet and said outlet.

2. The hand-held dryer of claim 1 wherein said inlet is substantially larger than said housing in the region of said fan.

3. The hand-held dryer of claim 1 wherein the thickness of said sound absorbing material decreases in the region between said fan and said inlet approximately linearly from a maximum adjacent said fan to a minimum adjacent said inlet.

4. The hand-held dryer of claim 3 wherein said substantially rigid housing between said fan and said inlet is substantially conical in shape with said inlet being substantially larger than the region adjacent said fan.

5. The hand-held hair dryer of claim 1 wherein said motor includes a motor support passing through an opening in said housing so as to not make mechanical contact therewith, and extending into said handle means, and said vibration isolation means couples said motor support and said handle means.

6. The hand-held hair dryer of claim 1 wherein said sound absorbing material has a porosity in the range of 0.8 to 0.99.

7. The hand-held hair dryer of claim 6 wherein said sound absorbing material has a porosity of approximately 0.96.

8. The hand-held hair dryer of claim 7 wherein said sound absorbing material is an aramid microfiber material.

9. The hand-held hair dryer of claim 1 further comprised of at least one substantially rigid open mesh screen-like member within said housing retaining said sound absorbing material to define said substantially smooth duct.

10. The hand-held hair dryer of claim 9 wherein said at least one screen-like member is physically separated from said housing so as to not be in direct mechanical contact therewith.

11. The hand-held hair dryer of claim 1 wherein said heater is mounted to said motor.

12. The hand-held hair dryer of claim 1 wherein said housing is coupled to said handle means through a housing vibration isolation means, said housing vibration isolation means being an elastic means for absorbing vibrational energy between said housing and said handle means.

13. The hand-held hairdryer of claim 1 wherein said shroud is mounted on a shroud vibration isolation means.

14. The hand-held hair dryer of claim 13 wherein said shroud vibration isolation means is mounted to said handle means.

15. The hand-held hair dryer of claim 1 further comprised of at least one Helmholtz oscillator means mounted within said housing and forming part of said duct, said Helmholtz oscillator means being a means for absorbing pressure disturbances at and near the resonant frequency thereof.

16. The hand-held hair dryer of claim 15 wherein said motor and fan operate at a predetermined speed, whereby said fan generates pressure disturbances having a primary component at a predetermined frequency equal to the fan blade passing rate, and wherein said at least one Helmholtz oscillator is tuned to have a resonant frequency substantially equal to said predetermined frequency.

17. The hand-held hair dryer of claim 16 wherein said at least one Helmholtz oscillator comprises first and second Helmholtz oscillators, each disposed adjacent said housing inlet and outlet, respectively.

18. The hand-held hairdryer of claim 1 wherein said fan is positioned between said motor and said inlet.

19. A hand-held hairdryer comprising a substantially rigid housing having a substantially smooth duct therein, including an inlet and an outlet for airflow therethrough;

a substantially rigid handle means, said housing being coupled to said handle means;

a motor mounted in said housing;

a fan mounted on said motor and oriented to encourage air flow through said housing from said inlet to said outlet;

an electric heater mounted in said housing downstream of said fan; and at least one Helmholtz oscillator mounted within said housing and forming part of said duct, said Helmholtz oscillator being a means for absorbing pressure disturbances at and near the resonant frequency thereof;

wherein said motor and fan operate at a predetermined speed, whereby said fan generates pressure disturbances having a primary component at a predetermined frequency equal to the fan blade passing rate, and wherein said at least one Helmholtz oscillator is tuned to have a resonant frequency substantially equal to said predetermined frequency.

20. The hand-held hair dryer of claim 19 wherein said at least one Helmholtz oscillator comprises first and second Helmholtz oscillators, each disposed adjacent said housing inlet and outlet, respectively.

21. The hand-held hair dryer of claim 19 further comprised of a sound absorbing material lining said housing between said inlet and said outlet thereof, said sound absorbing material being shaped so as to provide a substantially smooth duct to define, at least in part, said duct for airflow between said inlet and said outlet.

22. The hand-held hair dryer of claim 21 wherein said motor is retained within said housing by a motor support passing through an opening in said housing so as to not make mechanical contact therewith, and extending into said handle means, and further comprising vibration isolation means coupling said motor support and said handle means, said vibration isolation means being an elastic means for absorbing vibrational energy between said motor support and said handle means.

23. The hand-held hair dryer of claim 22 wherein said heater is mounted to said motor.

24. The hand-held hair dryer of claim 21 wherein said sound absorbing material has a porosity in the range of 0.8 to 0.99.

25. The hand-held hair dryer of claim 24 wherein said sound absorbing material has a porosity of approximately 0.96.

26. The hand-held hair dryer of claim 25 wherein said sound absorbing material is an aramid microfiber material.

27. The hand-held hair dryer of claim 24 further comprised of at least one substantially rigid open mesh screen-like member within said housing retaining said sound absorbing material to define said substantially smooth duct.

28. The hand-held hair dryer of claim 27 wherein said at least one screen like member is physically separated from said housing so as to not be in direct mechanical contact therewith.

29. The hand-held hair dryer of claim 24 wherein said housing is coupled to said handle means through a housing vibration isolation means, said housing vibration isolation means being an elastic means for absorbing vibrational energy between said housing and said handle means.

30. The hand-held hair dryer of claim 24 further comprised of a shroud encircling said fan, said shroud being mounted on a shroud vibration isolation means.

31. The hand-held hair dryer of claim 30 wherein said shroud vibration isolation means is mounted to said handle means.

32. The hand-held hairdryer of claim 31 wherein said shroud vibration isolation means is mounted to said handle means.

33. A hand-held hairdryer comprising a substantially rigid housing having an inlet and an outlet for airflow therethrough;

a substantially rigid handle means, said housing being coupled to said handle means;

a motor within said housing, said motor including a motor support passing through an opening in said housing so as to not make mechanical contact therewith, and extending into said handle means and being supported therein by vibration isolation means coupling said motor support and said handle means, said vibration isolation means being an elastic means for absorbing vibrational energy between said motor support and said handle means;

a fan mounted on said motor and oriented to encourage air airflow through said housing from said inlet to said outlet;

a shroud encircling said fan, said shroud being mounted on a shroud vibration isolation means;

an electric heater in said housing downstream of said fan and mounted to said motor; and a sound absorbing material lining said housing between said inlet and said outlet thereof, said sound absorbing material having a porosity in the range of 0.8 to 0.99 and being shaped so as to provide a substantially smooth duct for airflow between said inlet and said outlet.

34. The hand-held dryer of claim 33 wherein the said sound absorbing material and said housing are shaped to provide a substantially conical duct between said inlet and a region adjacent said fan, said conical duct being substantially larger at said inlet.

35. The hand-held hair dryer of claim 33 wherein said housing is coupled to said handle means through a housing vibration isolation means, said housing vibration isolation means being an elastic means for absorbing vibrational energy between said housing and said handle means.

36. The hand-held hairdryer of claim 33 wherein said fan is positioned between said motor and said inlet.

* * * * *